United States Patent [19]

Henson

[11] Patent Number: 4,779,864

[45] Date of Patent: Oct. 25, 1988

[54] ADJUSTABLE DOUBLE BEAM WEIGHTLIFTING APPARATUS

[76] Inventor: William D. Henson, Rte. 2, Box 426 A, Alachua, Fla. 32615

[21] Appl. No.: 77,739

[22] Filed: Jul. 27, 1987

[51] Int. Cl.[4] ..... A63B 21/00

[52] U.S. Cl. ..... 272/117; 272/DIG. H

[58] Field of Search ..... 272/62, 63, 103, 116, 272/117, 118, 120, 123, 134, DIG. H

[56] References Cited

U.S. PATENT DOCUMENTS

| | | | |
|---|---|---|---|
| 117,339 | 7/1871 | Simmons . | |
| 190,150 | 5/1977 | Lozier . | |
| 1,166,304 | 12/1915 | Albert | 272/117 |
| 3,364,747 | 1/1968 | Ebstein . | |
| 3,558,130 | 1/1971 | Anderson . | |
| 3,573,865 | 4/1971 | Annas et al. . | |
| 3,690,655 | 9/1972 | Chapman . | |
| 3,731,922 | 5/1973 | Jungreis | 272/117 |
| 3,905,599 | 9/1975 | Mazman . | |
| 3,912,263 | 10/1975 | Yatso | 272/118 |
| 4,357,010 | 11/1982 | Telle | 272/117 |
| 4,405,128 | 9/1983 | McLaughlin | 272/134 X |
| 4,406,452 | 9/1983 | Lapcevic | 272/123 |
| 4,407,495 | 10/1983 | Wilson . | |
| 4,422,636 | 12/1983 | De Angeli | 272/117 |
| 4,627,614 | 12/1986 | de Angeli . | |
| 4,640,268 | 2/1987 | Roberts | 272/DIG. 4 X |

FOREIGN PATENT DOCUMENTS

| | | | |
|---|---|---|---|
| 208551 | 4/1984 | German Democratic Rep. | 272/117 |

*Primary Examiner*—Richard J. Apley
*Assistant Examiner*—Robert W. Bahr
*Attorney, Agent, or Firm*—Dennis P. Clarke

[57] ABSTRACT

A weightlifting exercise apparatus is provided having a first and second beam member, the second beam member being selectively positionable in a longitudinal sense relative to said first beam member to provide a substantially continuous range of selectable exercise loads, ranging from a relatively large load to a very small load, as second beam member in some positions will act as a counterbalance to a primary load provided by the first beam member, and in other positions will supplement the exercise load provided by the first beam member; the apparatus further having a releaseable lock whereby the second beam member can be retained in a selected position.

15 Claims, 3 Drawing Sheets

ADJUSTABLE DOUBLE BEAM WEIGHTLIFTING APPARATUS

FIELD OF THE INVENTION

The present invention relates to weight lifting equipment used in exercise and physical conditioning.

BACKGROUND OF THE INVENTION

The great number of patents issued in the field of weightlifting equipment evidences the popularity of this type of exercise as a way to stay in shape or improve physical conditioning. Also, the variety of equipment invented and patented shows that there is a desire to go beyond the basic barbell and circular weight plates, also known as "free weights". A principal drawback associated with the use of free weights is that, when the lifter is working out with a weight amount at or near his "maximum", he is less capable of controlling and balancing the bar, thereby making the exercise unsafe unless one or more spotters (other weight lifters) are used. Weight lifting machines solve the control and balance problems in most instances, thereby making it safe for the lifter to perform the exercise without the need for spotters.

A primary concern in the design of weightlifting machines is providing the apparatus with a weight or set of weights to be used in performing the exercise. This becomes especially important if the machine is designed to allow a lifter to perform more than one type of exercise. It is well known that certain muscle groups of the body are capable of working against greater weights than others. Therefore, a machine must be capable of providing proper ranges of weight for all of the different exercises. An example of this situation is found in U.S. Pat. No. 4,407,495, issued to Wilson. This machine is capable of allowing the lifter to perform the bench press, shoulder or military press, various pulling exercises, and leg extensions. The problem of providing different weights required for the various exercises is solved in this machine by resorting to the use of free weight plates, and further allowing the position of the transverse bar holding the weights to be adjusted as necessary.

Although this machine avoids the control and balance problems previously mentioned as being associated with the use of a barbell, other undesirable features associated with the use of free weight plates in conjunction with exercise machines become evident here. First, a resonably extensive set of weight plates is required to allow various combinations of plates to be used in selecting the proper weight for a given exercise. The weight plates must be evenly distributed on either side of the exercise bar in order for proper operation at the pivot point of the machine. Additionally, many times plates weighing as much as 25 or 50 pounds (or standard metric weights, such as 100 kg) are used, and must be lifted from the ground into position onto the bar adapted to hold them Other types of machines, either of the single exercise type or multi-exercise type, employ a stack of plates disposed to be lifted along vertical guide elements. U.S. Pat. No. 3,905,599, issued to Mazman, is an example. The total amount of weight in the weight stack is determined by the equipment designer, and in general the designer attempts to provide sufficient weight for even the stronger members of the general public who might wish to use the equipment. The weight to be used in the exercise is selected by inserting a pin through an opening in a particular plate and through a cylindrical rod running vertically through the weight stack which has bores in alignment with the weight plate openings when the machine is at a rest position. In the machine shown in the Mazman patent, all weight plates above and including the pinned plate will be the ones which will be raised and lowered during the exercise.

While it would appear that this arrangement makes weight selection very simple, there are some not-so-apparent drawbacks which can frequently be evidenced in health clubs and weight training rooms where these machines are used by a wide assortment of individuals. The use of these plates requires that the weight selection be done in discrete increments. The weight plates most commonly used in these machines weigh ten pounds, and for machines designed for exercises requiring greater weight such as leg press machines, twenty-five pounds is the common size. The use of such increments inhibits the ability of a lifter to increase muscle strength consistently because the lifter is required to increase his maximum exercise weight in these large increments. It is very difficult to make such large jumps when the lifter is advancing beyond his or her personal maximums.

Frequently, one will see a lifter in a weight room improvise to avoid this problem by hanging a five-pound plate taken from the "free weight" plate assortment around the exposed end of a pin which has been inserted into the weight stack at a selected location. This allows the lifter to progress at five-pound increments on a ten-pound plate machine. Ten-pound free weight plates are frequently used in the same manner on machines having twenty-five pound increments. The pins are not usually long enough to hold more than one extra free weight plate and still operate properly. Thus, a lifter wishing to exercise with, for example, 47½ pounds of weight on a machine having 10-pound increments may or may not be able to hang a five-pound and a 2½ pound weight from a pin inserted at the 40-pound plate. The occurrence of this is frequent enough that devices have actually been developed which attach to the top plate of a stack and come in 2½, 5, and 10 pound increments.

A further disadvantage of weight stacks of this type is that if the desired smaller increments are provided in the stack, the number of plates must be correspondingly increased. Because the various sizes of this type of weight plate all have roughly the same height (changes in the length and width primarily accounting for the weight difference), it might not be possible to provide a sufficient number of plates on the machine for the stronger lifters to perform the exercise at a preferred weight. This situation would also arise in the multi-exercise machines using weight stacks having plates of smaller increments, wherein the weight stack may not have sufficient total weight for all of the various exercises.

One example of an exercise machine having an essentially continuous range of weight selections is seen in U.S. Pat. No. 3,573,865 issued to Annas et al. This machine, however provides a very complex, cumbersome and expensive arrangement for providing the continuous selection range. An electric motor is provided with threaded rod for moving a block along a rail element to adjust the position of the block relative to a pivot point.

It is therefore an important object of the present invention to provide a weightlifting exercise machine which provides a substantially continuous range of weight selections for performance of an exercise, ranging from very small exercise loads to large exercise loads.

It is a further important object of the present invention to provide a weightlifting exercise machine which provides a substantially continuous range of weight selections while at the same time is very easy to adjust and is low in cost.

It is a further important object of the present invention to provide a weightlifting exercise machine which is capable of allowing a user to perform more than one type of exercise which will permit the exercise of different muscle groups in the body.

It is a further important object of the present invention to provide a weightlifting exercise machine which has a heavy primary weight member and an adjustable heavy secondary weight member, the secondary member being capable of being positioned either to add substantial weight to the primary weight or to counterbalance much of the primary weight, or positioned anywhere between these two extreme positions.

SUMMARY OF THE INVENTION

The above and other objects of the present invention are accomplished by a weightlifting exercise machine comprising a first elongated beam member, a second elongated beam member which is slideably mounted on the first beam member, the second beam member having a releaseable lock means for selectively positioning the second beam member in a longitudinal relation to the first beam member, the machine further having a fulcrum means at a first end of the first beam member and a user engagement means operably coupled to the second end of the first beam member, whereby the first beam member acts as a primary load and the second beam member acts as a secondary load for exercising. The effective load for exercising on this machine is the combined effective weight of the beams acting as a downward force on the user engagement means, which is raised and lowered during the exercise cycle, pivoting the beam members about the fulcrum means.

The lock means will retain the second beam member in a preselected position relative to the first beam member, and is capable of being positioned such that a large portion of the length of the second beam is disposed on the opposite side of the fulcrum means from the first beam member, where it will counterbalance most of the weight of the first beam member acting at the user engagement means. This allows a small effective load to be used for a particular exercise. At another extreme, all or nearly all of the second beam member will be disposed on the same side of the fulcrum as the first beam member, thereby providing essentially no counterbalancing effect, but rather adding substantial weight to the effective load.

BRIEF DESCRIPTION OF THE DRAWINGS

These and other features of the present and attendant advantages will be readily apparent to those having ordinary skill in the art and the invention will be more readily understood from the following detailed description of the preferred embodiments of the present invention taken in conjunction with the accompanying drawings wherein like reference characters represent like parts throughout the several views.

DESCRIPTION OF THE PREFERRED EMBODIMENT

Figure 1:
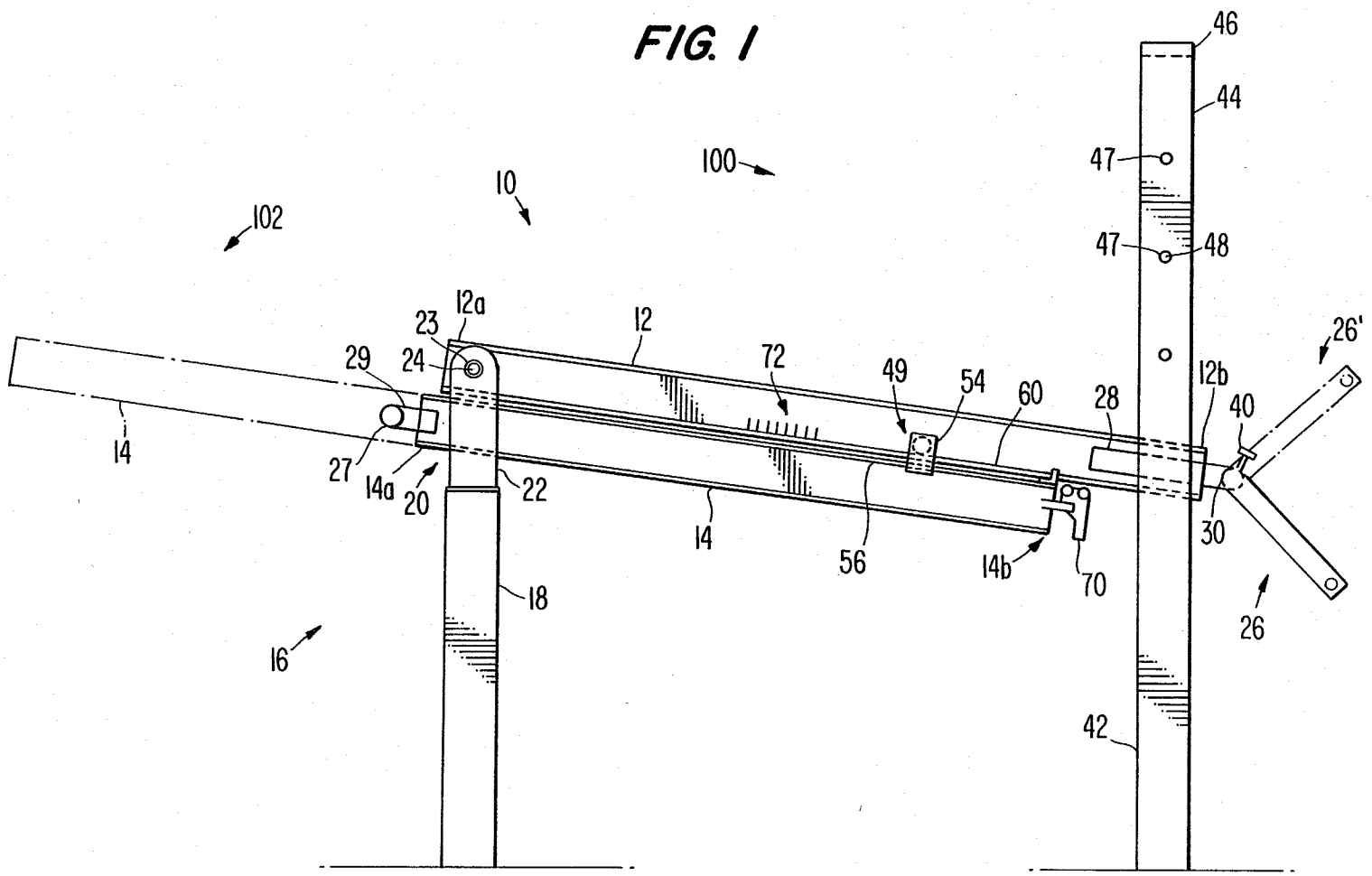
FIG. 1 shows a side elevation view of the weightlifting exercise machine of the present invention.

Referring initially to FIG. 1, a double beam weightlifting exercise machine 10 is depicted according to a preferred embodiment of the invention. Machine 10 comprises two elongated load members, first elongated beam member 12 and second elongated beam member 14. First beam member 12 is pivotably secured at a first end 12*a* to a fulcrum means 16, which, in the preferred embodiment comprises a post portion 18 and a fork portion 20 which is made up of two parallel, spaced metal plates 22 having a cylindrical pivot pin 24 connected to each plate 22 and further attached to first beam member 12. The connection is preferably effected by a fitting of the pivot pin 24 through a pair of circular bores 23 in the plates 22, either with or without the use of bearing elements.

Figure 2:
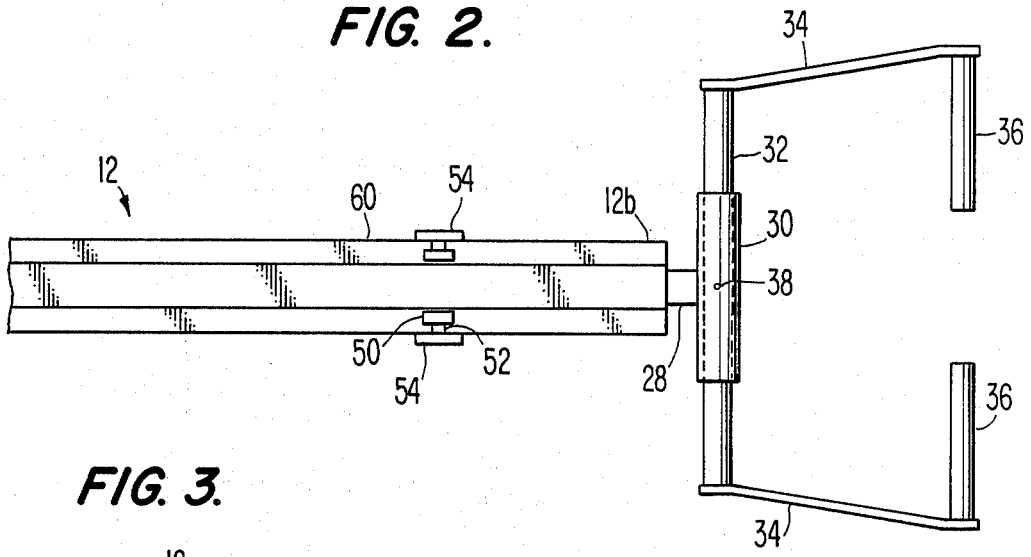
FIG. 2 shows a partial top plan view of the weightlifting exercise machine of the present invention.

A second end 12*b* of the first beam member 12 is operably coupled to a user engagement means 26. In this preferred embodiment, this means 26 comprises a connecting element 28 attached to and extending away from first beam member 12 is a direction generally along a longitudinal axis of first beam member 12. Attached to the end of connecting element 28 is transversely disposed sleeve 30 (see FIG. 2). Cylindrical rod or pipe 32 is disposed partially inside sleeve 30 and extends transversely outwardly from both ends of the sleeve. Extension bars 34 are connected at the ends of pipe 32 in a slightly greater than right-angle relation. Each extension bar 34 carries a cylindrical grip member 36, the grips being spaced apart from each other along a common transverse axis.

In this preferred embodiment, pipe 32 is capable of rotating within sleeve 30 which in turn allows grips 36 to be positioned at several different heights (see 26' in ghost lines in FIG. 1). The height may be changed according to the type of exercise to be performed or the size of the user. Sleeve 30 and pipe 32 are provided with means for locking the user engagement means into a set position so that an exercise may be performed. In this preferred embodiment, sleeve 30 is provided with a threaded bore 38 (FIG. 2) which accepts a threaded T-shaped element 40 which can be threaded into contact with pipe 32 inside the sleeve, selectively preventing pipe 32 from rotating. Other locking means may also be used and this means described is only by way of example.

Front post 42 is provided at the second end 12*b* of first beam member 12, near the user engagement means 26. Front post 42 provides a stop means for limiting the extent of downward travel of the second end 12*b* of first beam member 12. Alternatively, fulcrum member 16 may be provided with stop means in a situation where it is desired to eliminate front post 42. Front post 42 may also have vertically extending rails 44 connected at a top end by crosspiece 46. These rails 44 may serve as a vertical guide for first beam member 12 as it is moved through the range of motion during the exercise. Rails 44 contain, in this embodiment, a plurality of pairs of rail bores 47 spaced vertically along the rails. The use of a stop pin 48 through a selected pair of rail bores 47 will allow second end **12*b* of first beam member 12 to have an adjustable lower extent of downward travel, if desired. This feature, as well as the adjustable height grips 36** provide the user with many positions for performing several different exercises, e.g. the bench press and the military press.

Crosspiece 46 is disposed in a manner such that, if desired, a pulley (not shown) may be attached to the crosspiece 46 at this upper position, the pulley being adapted to carry a cable (also not shown) which would be attached at one end to first beam member 12 and attached at its other end to a user engagement means suited for performing pull-down exercises.

Although not depicted, it is readily ascertainable that a horizontal bench or a bench with an adjustable incline may be positioned with one end below user engagement means 26 such that the bench press and other supine exercises may be performed.

Figure 3:
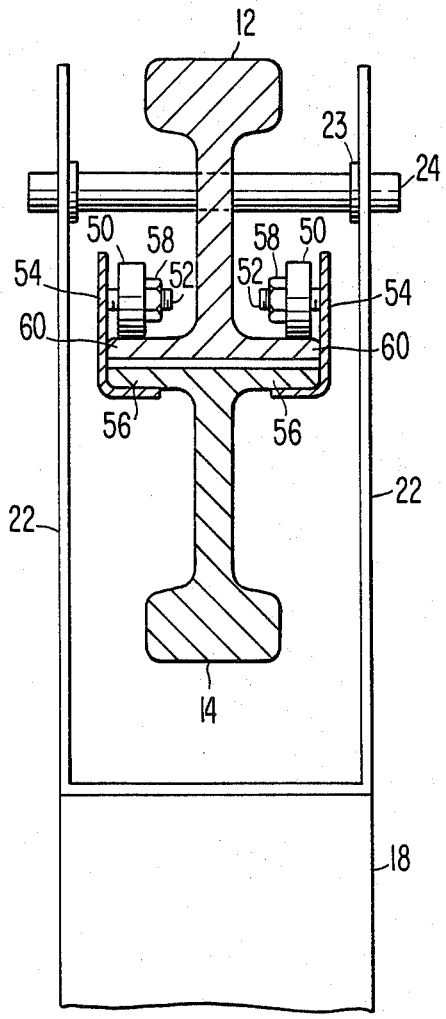
FIG. 3 is an end elevation view of the first and second beam members and top portion of the fulcrum means according to the present invention.

Second beam member 14 is slideably mounted on first beam member 12 by a roller suspension means 49 comprising a pair of rollers 50, as best seen in FIG. 3. In this end view it can be seen that, in this preferred embodiment, the first and second beam members 12, 14, are actually lengths of railroad rails. As seen in FIG. 3 first beam member 12 is oriented in the same way as when the rail is used for railroad track, and the second beam member 14 is in an upside down orientation. The wide bottom flanges of the railroad rails makes them well suited for use in this machine design. Railroad rails are also relatively inexpensive and are generally readily available and provide large amounts of weight for use in exercise.

Rollers 50 are attached by hanger means 51 comprising cylindrical extension members 52 which are depicted as threaded bolts each attached at one end to an angle member 54, preferably made of steel. Angles 54 are in turn connected, normally by welding, to second beam flange 56. Preferably a locking nut 58 is threaded onto each extension member 52 to maintain the rollers 50 in proper position. Rollers 50 in the preferred embodiment are actually antifriction bearings in which an inner bore is fixed in relation to extension members 52.

Rollers 50 are disposed to roll along the upper surface of first beam flange 60 on both sides thereof, as depicted in FIG. 3. Also seen in FIG. 3 is the clearance 62 provided by parallel plates 22 between the underside of first beam member 12 and post 18. This clearance 62 is provided to allow second beam member to extend longitudinally beyond fulcrum means 16 on the side 100 of fulcrum means 16 opposite the side having the user engagement means 26.

It can thus clearly be seen, referring back to FIG. 1, that second beam member 14 is capable of providing substantial load for use in an exercise when it is positioned in what will be termed its extreme forward position, i.e. when second beam member 14 is nearly entirely on the user engagement side 102 of fulcrum 16. This is the position shown in solid lines in FIG. 1. Also, as can be seen in FIG. 1, second beam member 14 is adapted to be moved to an extreme rearward position (shown in phantom lines) wherein it will not provide any substantial load for use in exercise and will, in fact, act as a counterbalance to effectively counter much of the load provided by the weight of first beam member 12 at the user engagement means 26. Additionally, second beam member 14 is provided with releasable locking means 70, the operation of which is explained in more detail in a later paragraph, which allows second beam member 14 to be positioned at either extreme position and also a continuous range of positions in between. This permits a substantially continuous range of weights which can be selected for the performance of weightlifting exercises, from a substantial load to a very light load. The maximum and minimum loads which a machine of the present invention can provide for an exercise may be varied from machine to machine, if desired. The length of each rail as well as the limits on the range of motion of the second beam member 14 can be varied to produce different maximum and minimum weights. By way of example, a machine according to the present invention may be provided having a minimum exercise load on the order of 20 pounds and a maximum exercise load on the order of 150–200 pounds.

It can be readily be envisioned that as the position of second beam member 14 is moved rearward, it will reach a point where it is producing an equal downward force on both sides of the fulcrum 16. At this point the effective load for the exercise is the load provided by first beam member 12 only. As second beam member 14 is moved further in a rearward direction, it begins to act in a counterbalancing manner to reduce the exercise load to an amount lower than the load provided by the first beam member. First and second beam members 12, 14 need not be the same weight, and it may be desired to provide a second beam member which is heavier than the first beam member to allow a greater range of weight selections available for exercise.

An alternate user engagement means such as a straight, barbell-type bar 27 may also be provided on the machine 10, attached to a back end **14*a* of the second beam member 14 by bracket 29. This bar 27 would be used to perform pull-down exercises at the rear of the machine instead of providing a pulley and cable system at the front of the machine as previously described. Bar 27 should be long enough to permit common pull-down exercises such as those used to develop "lats" (the latissimus dorsi muscles), wherein the bar is usually gripped at wider-than-shoulder-width distances. In addition, it is envisioned that a machine according to the present invention could be designed having the sliding rail weight adjustment means, for use exclusively as a pull-down type exercise machine. If it is desired to have such a machine, there would be no need for user engagement means 26, the machine requiring only alternate user engagement means 27**.

A series of indicating lines or markings 72 can be spaced along first beam member 12. Alternatively, lines 72 may be placed on a metal strip and attached to first beam member 12. These lines 72 will be used to aid the user in selecting a desired exercise weight. The lines will be disposed and marked in a manner such that when a predetermined portion of the second beam member is brought into alignment with one of lines 72, the effective load, i.e. the load contributed by the first beam member 12 and the second beam member 14 (which may be additive or subtractive), will be indicated by the line 72.

The predetermined portion of the second beam member used for alignment with the lines 72 of the first beam member can be one of several options. The front 14*b* of second beam member 14 may be used as the alignment means. If desired, a pointer element (not shown) could be attached at this front end and would extend up and around the flanges of the first and second beam members 12, 14, to make it easier to determine when the desired position is achieved. Alternatively, angle 54 may be used, or part of locking means 70, or a line (not shown) similar to lines 72 may be provided on second beam member 14. The lines 72 will be positioned on first beam 12 to allow an accurate visual alignment with the selected alignment means of second beam member 14. Also, if numbered weight indications are used, these can be determined based on the weights of first and second beam members 12, 14 and the contributed weight of user engagement means 26, the lines 72 and markings being made to correspond to various positions of the second beam member 14.

Figure 4A:
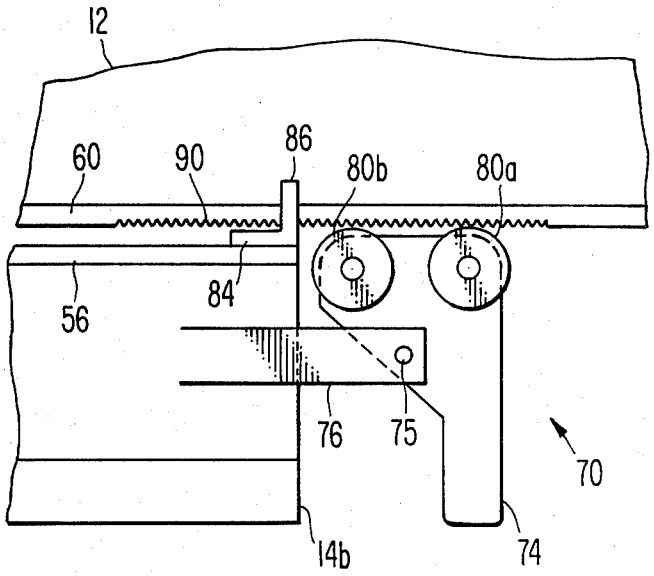
FIGS. 4*a, b* and *c* are partial side elevation views of the weightlifting machine of the present invention showing the operation of the lock means according to the preferred embodiment of the invention.
Figure 4B:
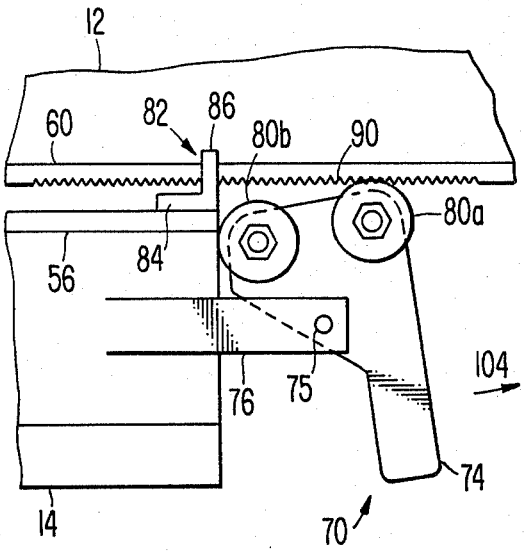
Figure 4C:
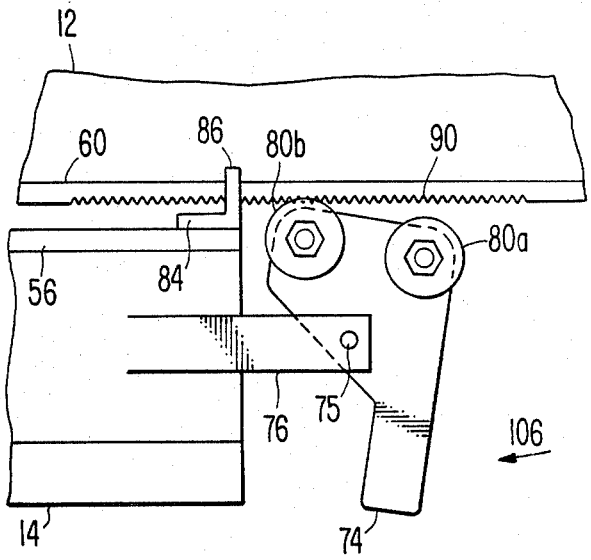

Turning now to FIGS. 4*a*, *b*, and *c*, the releasable locking means 70 in the preferred embodiment of the present invention will be described. FIG. 4*a* shows the locking means 70 in the locked configuration, while FIGS. 4*b* and 4*c* show the locking means 70 in two different unlocked configurations.

Figure 5:
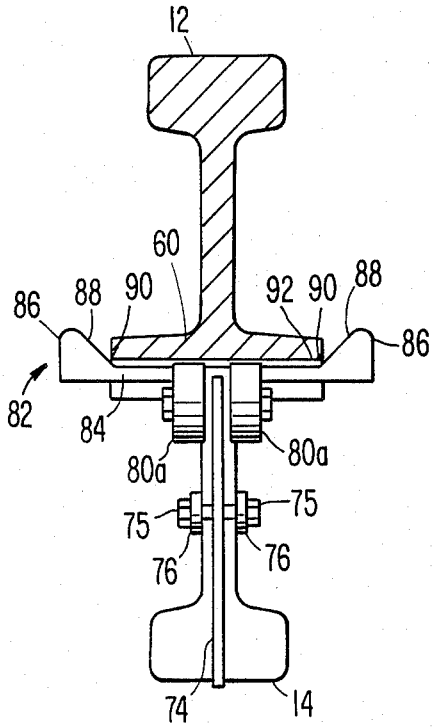
FIG. 5 is an end elevation view of the first and second beam members and the lock means according to the present invention.

In this preferred embodiment a releasing lever 74 is provided and is pivotably mounted via throughbolt 75 to standoff bars 76 (see also FIG. 5), which are connected at the front 14*b* of second beam member 14. Releasing lever 74 has a top portion 78 which rotatably carries front bearing member 80*a* and rear bearing member 80*b*. Preferably the front and rear bearing members will actually each constitute a pair of bearing members disposed on either side of lever 74 (see 80*a*, FIG. 5). The lever 74 and bearing member 80*a*, 80*b* operate to engage and disengage lock plate 82, which is disposed on the upper side of flange 56 of second beam member 14, from the lower side of flange 60 of first beam member 12. Lock plate 82 is made up of a flat plate member 84 which has outer tabs 86 (FIG. 5) on either side which extend perpendicularly upwardly from plate member 84 (as viewed from the side as in FIG. 4*a*) and have angled engagement faces 88 for engaging the lower side of flange 60 of first beam member 12.

In the preferred embodiment, the front 14*b* of second beam member 14 is urged upwardly toward the lower side of flange 60, due to the placement of the roller suspension means 49 (see FIG. 1). Second beam member 14 is mounted from first beam member 12 only by the rollers, and in the preferred embodiment rollers 50 and angles 54 are positioned forward of the center of balance of second beam member 14. This places more of the weight of second beam member on the side of rollers 50 opposite the front 14*b* of the beam 14, thus inducing a bias urging front end 14*b* upwardly into contact (via lock plate 82) with the underside of flange 60. While the induced rotational bias is generally sufficient to lock the beams in a selected fixed relative position, the lower side of flange 60 may optionally be provided with serrations or notches 90 disposed along the lower side and edges 92 of flange 60. These serrations will improve the retention capability of the lock means 70 as they provide an irregular contact surface which will increase the resistance to slippage.

Thus, the locked position of second beam member 14 is an equilibrium position of the beams, and when second beam member 14 is locked releasing lever 74 is in a neutral position, i.e. having neither front bearing members 80*a* nor rear bearing members 80*b* in contact with the lower side of flange 60 of first beam member 12.

The manner of unlocking and sliding second beam member 14 relative to first beam member 12 can be seen in FIGS. 4*b* and 4*c*. Second beam member 14 is unlocked by separating lock plate 82 from first beam member 12 using releasing lever 74, which can be moved in either a forward or rearward direction.

When it is desired to slide second beam member 14 forward to increase the exercise load, lever 74 is pulled forward in the direction of arrow 104 in FIG. 4*b*. This lever motion brings front bearing members 80*a* into contact with the under side of flange 60. Further lever rotation causes the throughbolt 75, standoff bars 76 and front end 14*b* of second beam member to move downwardly, which disengages lock plate 82 from first beam member 12. In this position, second beam member 14 is supported by bearing members 80*a* and rollers 50, thereby allowing the beam 14 to slide longitudinally, as bearing members 80*a* and rollers 50 track along first beam member 12, toward the front of the apparatus.

When it is desired to reduce the exercise load, lever 74 is pivoted toward fulcrum 16 in the direction of arrow 106 in FIG. 4*c*. It can be seen in this figure that when lever 74 is pivoted in this direction, bearing members 80*b* are moved into contact with the lower side of flange 60, and will operate to separate lock plate 82 from flange 60 in much the same manner as previously described with respect to bearing members 80*a*.

FIGS. 4*b* and 4*c* show that, by using two sets of bearing members 80*a*, 80*b* on lever 74, the lever 74 is operated in the same direction in which it is desired to move second beam member 14, which makes changing the exercise weight a simple task. After the desired position for the second beam member 14 is reached, the lever is released, whereupon front 14*b* of beam 14 will move upwardly and lock plate 82 will engage the lower part of flange 60 to lock the beam 14 in position. Subsequent adjustments or repositionings are made by pushing or pulling on lever 74 and sliding second beam member 14 in the desired direction.

Figure 6:
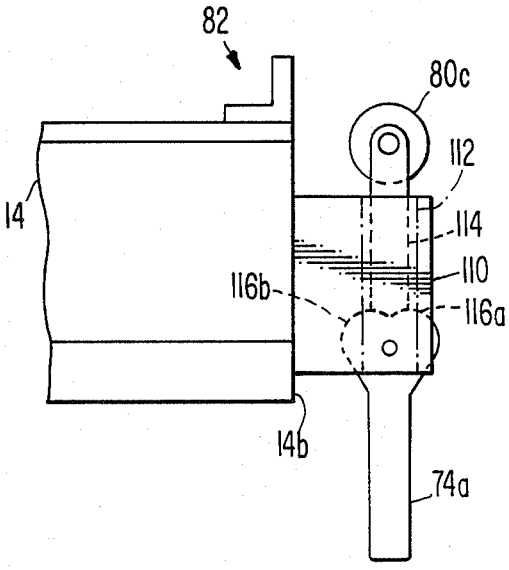
FIG. 6 is a side elevation view of an alternate embodiment for the lever portion of the lock means of the present invention.

FIG. 6 shows an alternate embodiment of the lever and bearing member portions of releaseable lock means 70. In this embodiment, second beam member 14 has a bracket 110 extending forward of front end 14*b*. Bracket 110 has a hollow channel 112 which houses pushrod 114 in a vertical orientation. Pushrod 114 has a bearing member 80*c* rotatably secured at a top section. Disposed at a lower end of pushrod 114, at the bottom of channel 112, bracket 110 pivotably retains lever 74*a*. Lever 74*a* is disposed in a position to contact the lower surface of pushrod 114, and contains two camming surfaces 116*a* and 116*b*.

A user of the weightlifting apparatus would operate this embodiment of lock means 70 much in the same manner as the previously described embodiment. The second beam member 14 contains the same lock plate 82 as the other embodiment, and the second beam member 14 as mounted on first beam member 12 is normally in the locked position. Should the user wish to reposition second beam member 14, lever 74*a* is pushed or pulled as previously described. When this is done, either camming surface 116*a* or 116*b* will urge pushrod 114 upwardly, causing bearing member 80*c* to contact flange 60 (FIG. 5) and separate lock plate 82 therefrom. Second beam member then is capable of sliding longitudinally with respect to first beam member 12, with the assistance of rollers 50 and bearing member 80*c*.

Although details and elements have been specified in the foregoing description of the preferred embodiment, it is to be appreciated that these are for illustrative purposes only. Numerous modifications and adaptations will be readily apparent to those of ordinary skill in the art. Accordingly, the scope of the present invention should be determined by reference to the appended claims.

I claim:

1. A weightlifting exercise apparatus comprising:

a first beam member having sufficient weight to provide an exercise load for weight lifting exercise and having a horizontally disposed first beam flange at a lower side;

a second beam member having sufficient weight to provide an exercise load for weight lifting exercise and being slideably mounted on said first base member, said second beam member having a releasable lock means for selectively positioning said second beam member relative to said first beam member and being provided with rollers attached by associated hangers, said rollers being disposed to engage and roll along a top surface of said horizontal flange;

a fulcrum means for pivotably securing a first end of said first beam member; and a user engagement means operably coupled to a second end of said first beam member, wherein said first beam member provides a primary load for exercising, and said second beam member is releasably locked in a position relative to said first beam member to provide a secondary load for exercising.

2. An exercise apparatus as defined in claim 1 wherein said fulcrum means comprises a post adapted to be secured to a horizontal surface, said post having two parallel plates extending upwardly from a top portion of said post, said first beam member being pivotably secured to said fulcrum between said plates by a pivot pin means extending from each of said plates and connected to said first beam member.

3. An exercise apparatus as defined in claim 2 wherein said first beam member is pivotably secured to said plates at a predetermined height, said first beam member and said plates defining an opening above said post and under said first beam member, said opening being of sufficient size to allow said second beam member to pass therethrough.

4. An exercise apparatus as defined in claim 1 wherein said first beam member and said second beam member each comprise a predetermined length of a rail of the type used as railroad tracks, a first beam flange of said first beam member being disposed along a lower portion thereof, and a second beam flange of said second beam member being disposed along an upper portion thereof.

5. An exercise apparatus as defined in claim 4 wherein said second beam member further comprises a roller suspension means for mounting said second beam member to said first beam member, said roller suspension means extending upwardly from said second beam member and having a pair of rollers disposed to ride along an upper surface of said first flange of said first beam member.

6. An exercise apparatus as defined in claim 5 wherein said roller suspension means is disposed along said second beam member at a position forward of a center of balance of said second beam member, whereby a front end of said second beam member is urged upwardly toward said first beam flange.

7. An exercise apparatus as defined in claim 6 wherein said releaseable lock means comprises a lock plate disposed on an upper surface of said second beam flange of said second beam member at a point near the front end thereof, a pivotably mounted lever disposed in a position forward of said front end of said second beam member, and at least one bearing member in communication with said lever, wherein when said lever is in a neutral position, said lock plate is in contact with a lower surface of said first flange, and when said lever is pivoted, said lever is disposed to raise said bearing member into contact with said lower surface of said first flange to disengage said lock plate from contact with said lower surface of said first flange, thereby permitting said second beam member to be moved longitudinally with respect to said first beam member in a sliding manner.

8. An exercise apparatus as defined in claim 7, wherein said lower surface of said first flange of said first beam member has serrations along outer edges of said flange.

9. A weight lifting exercise apparatus comprising:

a first and a second beam member having elongated forms, each having sufficient weight to provide an exercise load for weight lifting exercise;

a releaseable locking means for retaining said second beam member in a selected position relative to said first beam member;

fulcrum means for pivotably securing said first beam member at a first end thereof; and a user engagement means operably coupled to a second end of said first beam member; wherein said first beam member and said second beam member are disposed in a substantially parallel manner, and said second beam member is suspended from said first beam member and is capable of longitudinal relative movement with respect to said first beam member wherein:

said first beam member is disposed to provide a primary load at said user engagement means for use in a weightlifting exercise, and said second beam member is adjustably positionable to positions wherein said second beam member will effectively increase an exercise load by providing a secondary load, and said second beam member is further adjustably positionable to positions wherein said second beam member will effectively decrease an exercise load by providing a counterbalancing load to said primary load.

10. An exercise apparatus as defined in claim 9 wherein said first beam member has a first lower flange and said second beam member has a second upper flange and wherein said second beam member is suspended by a roller suspension means for slideably mounting said second beam member to said first beam member, said roller suspension means comprising a pair of rollers disposed above said first lower flange and hanger means attached to said second beam member extending around a pair of side edges of said first lower flange.

11. An exercise apparatus as defined in claim 10 wherein said roller suspension means is disposed in a position forward of a center of balance of said second beam member and a front end of said second beam member has a lock plate disposed on said second upper flange which will contact a lower surface of said first lower flange of said first beam member in an equilibrium position of said beams.

12. An exercise apparatus as defined in claim 11 wherein said releaseable locking means comprises at least one selectively raiseable bearing member which is disposed in a position to disengage said lock plate from said lower surface of said first lower flange whereby longitudinal movement of said second beam member with respect to said first beam member may be effected.

13. An exercise apparatus as defined in claim 12, wherein said releaseable locking means further comprises a lever, said lever being coupled to said selectively raiseable bearing member, said lever being pivotably mounted at the front end of said second beam member, said lever further being adapted to selectively raise said bearing member when said lever is pivoted.

14. An exercise apparatus as defined in claim 13 wherein said locking means comprises a front pair and a rear pair of bearing members disposed at an upper portion of said lever, said front pair of bearing members being adapted to be raised into contact with said lower surface of said first lower flange when said lever is pivoted away from said front end of said second beam member, and said rear pair of bearing members being adapted to be raised into contact with said lower surface when said lever is pivoted toward said front end, said contact of either pair of bearing members effecting a separation of said lock plate from said lower surface of said first lower flange.

15. An exercise apparatus as defined in claim 9 wherein said first beam member has indicating lines and said second beam member has an alignment means disposed to assist a user in selecting an exercise weight.

* * * * *